US005321379A

United States Patent [19]

Martin et al.

[11] Patent Number: 5,321,379

[45] Date of Patent: Jun. 14, 1994

[54] TRANSFORMER WITH AMORPHOUS ALLOY CORE HAVING CHIP CONTAINMENT MEANS

[75] Inventors: Duane L. Martin, Hickory; Donald E. Ballard, Conover, both of N.C.; Alan R. Traut; Rob McClellan, both of Lexington, Ky.

[73] Assignee: General Electric Company, Malvern, Pa.

[21] Appl. No.: 2,738

[22] Filed: Jan. 11, 1993

[51] Int. Cl.[5] ..... H01F 27/02; H01F 27/26

[52] U.S. Cl. ..... 336/90; 206/563; 229/145; 336/92; 336/234

[58] Field of Search ..... 206/562, 563, 395, 396, 206/397; 229/145, 146; 336/90, 92, 94, 216, 217, 234, 209, 184

[56] References Cited

U.S. PATENT DOCUMENTS

| | | | |
|---|---|---|---|
| 2,679,971 | 6/1954 | Goldberg | 206/563 |
| 3,201,024 | 8/1965 | Brokop | 206/562 |
| 3,326,445 | 6/1967 | Goings | 206/562 |
| 3,400,875 | 9/1968 | Coe | 206/563 |
| 3,434,650 | 3/1969 | Goings | 306/563 |
| 3,722,781 | 3/1973 | Page et al. | 206/563 |
| 4,222,023 | 9/1980 | Beech | 336/209 |
| 4,402,406 | 9/1983 | Weathers et al. | 206/562 |
| 4,673,907 | 6/1987 | Lee | 336/92 |
| 4,734,975 | 4/1988 | Ballard et al. | 29/606 |

*Primary Examiner*—Thomas J. Kozma

*Attorney, Agent, or Firm*—Henry J. Policinski; William Freedman

[57] ABSTRACT

This transformer comprises a tank containing insulating liquid and an amorphous alloy core within the liquid comprising spaced-apart upper and lower yokes and two spaced-apart legs at opposite ends of the yokes. Coil structure surrounds the legs, locating the yokes outside the coil structure and locating the legs within two windows of the coil structure. A box-like enclosure primarily of electrical insulating material encloses the lower yoke and is positioned to capture therein chips of amorphous alloy that might become detached from the core and fall toward the bottom of the tank.

A first portion of the box-like enclosure extends between the two windows of the coil structure and is held against the bottom of the coil structure. This first portion includes flaps that are folded upwardly into the two coil windows to form liners for these windows, but still leaving clearance space within the windows around the core legs through which detached chips may fall past the liners into the box portion of the enclosure. The box-like enclosure also includes portions which are folded about the lower yoke to form a box that includes said first portion of the enclosure as a lid.

7 Claims, 8 Drawing Sheets

TRANSFORMER WITH AMORPHOUS ALLOY CORE HAVING CHIP CONTAINMENT MEANS

CROSS-REFERENCE TO RELATED PATENTS

The subject matter of this patent application is related to that of the following patents, each of which is incorporated by reference herein:

U.S. Pat. No. 4,673,907—Lee

U.S. Pat. No. 4,734,975—Ballard and Klappert

BACKGROUND

This invention relates to an electric transformer and, more particularly, to a transformer having a core of amorphous ferromagnetic alloy.

Traditionally, the cores of electric transformers have been made of grain-oriented silicon steel laminations. In recent years, however, amorphous ferromagnetic alloy has been increasingly used in such applications in order to decrease core operating losses. This amorphous alloy is available in the form of very thin strip material which is quite brittle, especially after annealing. Using this strip material for core laminations, it is very difficult to make a laminated amorphous alloy transformer core and to incorporate such core in the transformer without some chipping or breaking of the edges of the core laminations. Most such chips can be removed during the manufacturing process, but there is a chance that a small quantity will appear or be developed later.

The presence of loose metal chips in a transformer is very undesirable since such chips can deposit on and short out winding insulation and can reduce the dielectric strength of the insulating oil in the transformer. Either of these conditions can lead to a failure of the transformer.

OBJECTS AND SUMMARY

An object of my invention is to capture and contain any metal chips detached from the amorphous alloy core and unremoved during the manufacturing process, in a location where the chips will not produce the above described failures.

Another object is to provide simple, inexpensive, effective and easily-incorporated means for capturing and containing such chips.

Still another object is to provide a chip-containment box having a portion that serves during linking of the transformer core and coil structures as a barrier that covers one face of the coil structure and protects this face from chips detached from the joints in the core structure when these joints are being reclosed.

In carrying out the invention in one form, we provide a transformer that comprises a tank containing insulating liquid. Within the liquid there is an amorphous alloy core comprising spaced-apart upper and lower yokes and two spaced-apart legs at opposite ends of the yokes. Coil structure surrounds the legs, locating the yokes outside the coil structure and locating the legs within two windows of the coil structure. A box-like enclosure primarily of electrical insulating material encloses the lower yoke in a position outside the coil structure and is positioned to capture therein chips of amorphous alloy which might become detached from said core and fall toward the bottom of the tank.

This box-like enclosure comprises a first portion that extends between the two windows of the coil structure and is held against the bottom of the coil structure. This first portion includes flaps that are folded upwardly into the two coil windows to form liners for these windows, but still leaving clearance space within the windows around the core legs through which detached chips may fall past the liners into the box portion of the enclosure. The box-like enclosure also includes portions which are folded about the lower yoke to form a box that includes said first portion of the enclosure as a lid.

BRIEF DESCRIPTION OF THE DRAWINGS

For a better understanding of the invention, reference may be had to the following detailed description taken in connection with accompanying drawings, wherein:

In FIG. 4, the core 20 is shown still separated from the coil structure 17, 18.

In FIG. 7, portions 90, 91, and 92 of the chip-containment board 40 still are unfolded.

DETAILED DESCRIPTION OF EMBODIMENT

Figure 1A:
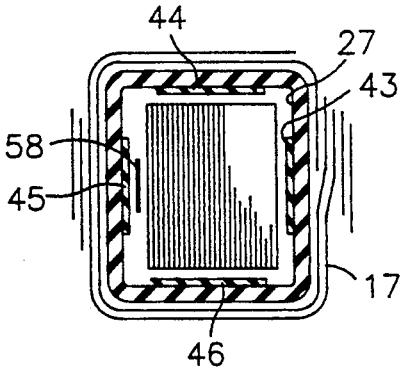
FIG. 1*a* is a sectional view taken along the line 1*a*–1*a* of FIG. 1.
Figure 1:
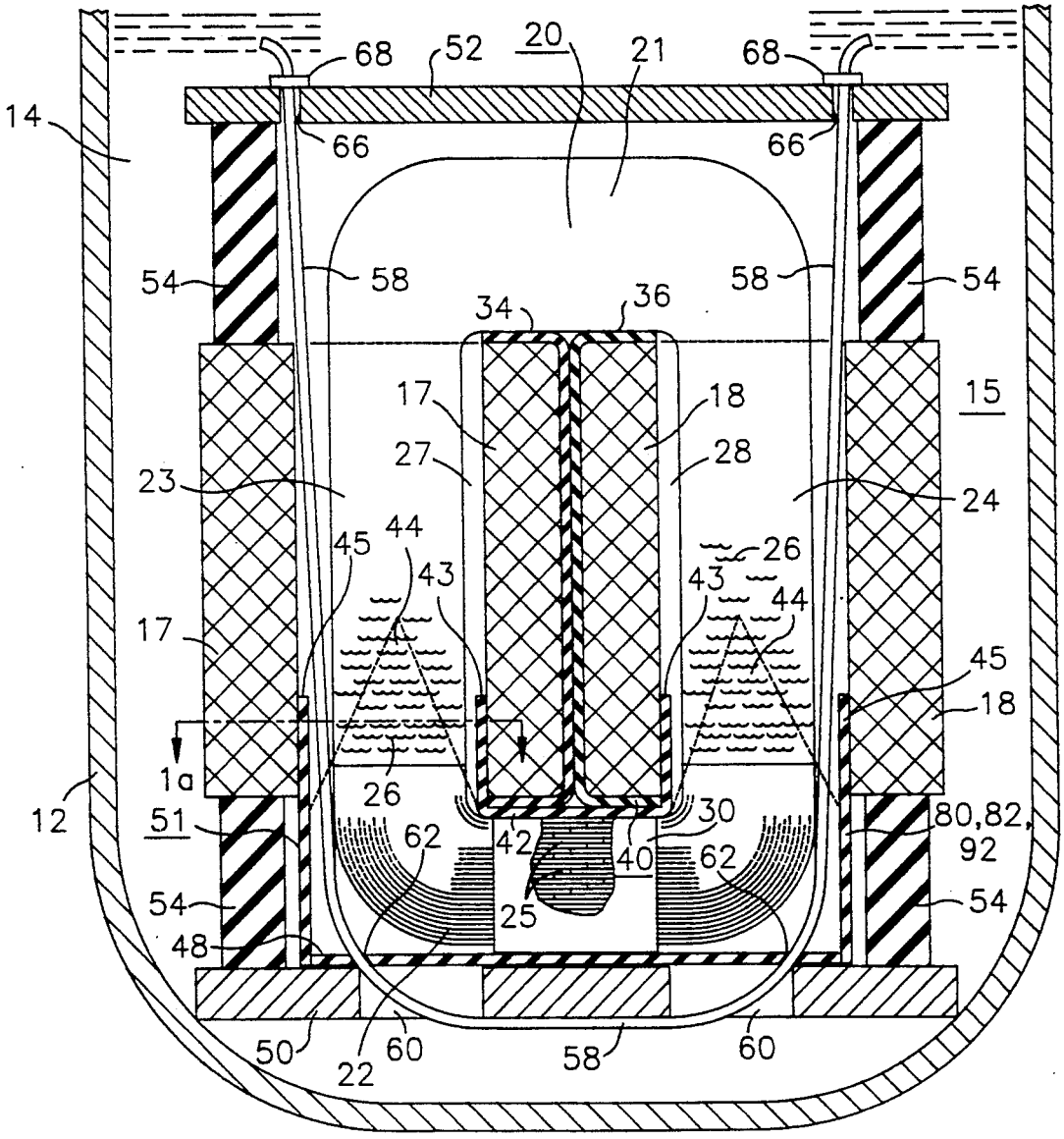
FIG. 1 is a front elevational view, partly in section and partly schematic, of a core-type transformer embodying one form of our invention.

Referring now to FIG. 1, the transformer shown therein is a distribution transformer comprising a metal tank or enclosure 12 containing an insulating liquid 14. Within the insulating liquid is the core and coil assembly 15 of the transformer.

This assembly 15 comprises two coils 17 and 18 and a wound laminated core 20 of amorphous ferromagnetic alloy linked to the coils. Prior to its incorporation into assembly 15, the core 20 is made from amorphous alloy in strip form, such as that commercially available from Allied-Signal Corporation as its Metglas 2506-S2 material. The core may be made in any number of different ways. One such way involves winding the amorphous strip into an annular form (not shown), cutting the annular form along a single radial line thereby creating separate laminations, and then reassembling the laminations to form a second annulus (not shown) with distributed lap joints in a localized region of the second annulus.

Then the second annulus is formed into the generally rectangular shape shown in FIG. 1, so that it comprises four integrally-connected sides consisting of two yokes 21 and 22 and two legs 23 and 24 at opposite ends of the yokes, with the joints (shown at 25) being located in the lower yoke 22. After this forming step, the core is annealed to relieve the stresses resulting from the earlier fabrication steps. Then, a thin layer of adhesive bonding agent, shown at 26 in FIG. 1, is applied to the lateral edges of the laminations in the upper yoke 21 and in the two legs 23 and 24. The lower yoke 22 and the corner regions of the core at opposite ends of the lower yoke are kept free of this bonding agent in order to permit ready displacement of these core portions during subsequent lacing of the core into the coils. After bonding, the joints 25 are opened, and the portions of the yoke at opposite sides of the joints 25 are displaced into positions of alignment with the legs 23 and 24 to convert the core into a U-shaped structure that can be easily laced into the two coils 17 and 18, which had been pre-wound in a conventional manner. The steps referred to in this paragraph and in the immediately-following paragraph are described in more detail in the aforesaid U.S. Pat. No. 4,734,975—Ballard and Klappert and U.S. Pat. No. 4,673,907—Lee.

Lacing is accomplished by inserting one leg of the above-described U-shaped core structure into the central passageway, or window, 27 of pre-wound tubular coil 17 and the other leg into the central passageway, or window, 28 of pre-wound tubular coil 18. For guiding each core leg and for protecting the laminations of the leg during the insertion process, a pair of thin sheet-metal splints (not shown) are provided about each leg prior to insertion and are then slid off after insertion. These splints are described in more detail in the aforesaid U.S. Pat. No. 4,734,975—Ballard et al and are shown at 29 in FIG. 3 of said patent. Thereafter the displaced yoke portions of the core are returned to their closed-joint positions of FIG. 1 to remake the joints 25. A sleeve of insulating material, preferably a suitable kraft paper, is then applied to the yoke 22 about the region of joints 25. This sleeve is shown at 30 in FIG. 1. Preferably, the sleeve is formed from a sheet of kraft paper which is snugly wrapped around the joint region, following which its ends are taped together.

Before the core is laced into the coils as above described, two channel-shaped insulating members 34 and 36, referred to as core shields, are respectively applied to the coils in the locations shown in FIG. 1. The horizontal flanges of these channel-shaped members act as spacers which prevent the inner surfaces of the yokes 21 and 22 from directly contacting the edges of coils 17 and 18 and thus reducing the dielectric strength of the coil structure. The insulating members 34 and 36 also space and provide insulation between the juxtaposed outer peripheries of the coils 17 and 18. It is to be understood that the high voltage windings of the transformer are located in the radially outer region of each coil 17 and 18, and it is therefore important to maintain a high dielectric strength of the insulation in these regions. These insulating members 34 and 36 are described in more detail in the aforesaid Lee U.S. Pat. No. 4,673,907.

Another step that is performed before the core is laced into the coils is that a chip-containment board 40, as shown in FIG. 1, made of electrical insulating material, preferably electrical- grade kraft paper about 10 mils thick, is fixed to the lower end of the two coils 17 and 18. Referring to FIG. 1, this chip-containment board 40 comprises a portion 42 that extends between the two coil windows and includes at each of it horizontal-spaced ends four triangular flaps 43, 44, 45, and 46 projecting upwardly therefrom, the sets of flaps forming two liners which are respectively positioned within the two coil windows. The four flaps forming each liner are preferably taped in place against the four walls of the associated rectangular coil window 27 or 28, as will soon be described in more detail. The chip-containment board 40 includes additional portions 47, 48, and 49 which are folded into a chip-containment box 51 that is adapted to surround the lower yoke 22 of core 20; but such folding is performed only after the core 20 has been laced into the coils and the lower yoke portions of the core have been returned to their closed-joint position of FIG. 1 to remake the joints 25. The folding operation for forming the chip-containment box 51 will soon be described in more detail.

The next step in the transformer assembly process is to incorporate horizontal top and bottom clamping plates 50 and 52 between which the coil structure 17, 18 is clamped. These horizontal plates 50 and 52 are separated from the coil structure 17, 18 by vertically-extending rigid plates, or blocks, 54 of insulating material. At the upper end of the coil structure 17, 18, two of these plates 54 are disposed perpendicular to the upper horizontal plate 52 as best seen in FIG. 1. At the lower end of the coil structure 17, 18, two of the plates 54 are disposed perpendicular to the lower horizontal plate 50 and on opposite sides of the box 51.

The two horizontal plates 50 and 52 are forced toward each other by forces developed through a flexible clamping band 58, preferably of steel, that is placed in tension. As best seen in FIG. 1, this band extends upwardly through two openings 60 in the bottom horizontal plate 50 and through two slots 62 in the bottom wall 47 of the chip-containment box 51, then upwardly through the windows 27, 28 of the coils 17 and 18, and then through openings 66 in the upper horizontal plate 52. This band 58, which is looped around the portion of bottom horizontal clamping plate 50 between openings 60, is suitably tightened to place it under tension, and suitable clips 68 are applied to its free ends to hold it in its tightened state.

The horizontal clamping plates 50, 52, being forced together by tensile forces in band 58, clamp the coil structure 17, 18 between the vertically-extending insulating plates 54. The vertically-extending plates 54 have sufficient height to avoid applying compressive forces via the chip-containment box 51 from the clamping plates to the core 20.

As pointed out in the introductory portion of this specification, the amorphous ferromagnetic alloys that are available today are rather brittle and occasionally break and chip, especially along the edges of any thin strips composed thereof. The illustrated core is made of such strip, and it is therefore possible for some chipping thereof to occur at the edges of such strip, which are located along the core face facing the viewer in FIG. 1 and the parallel back face, as well as at the joints 25. The adhesive coating at 26 provides significant protection against such chipping and helps to contain chips that are developed, but it is not completely effective in this respect in the bonded areas and, moreover, has little effect in the areas not covered by the coating 26, e.g., along the bottom yoke 22 and at the joints 25. Most such chips can be removed during the manufacturing process, but there is a chance that some can appear or be developed later.

The presence of loose chips especially in the insulating liquid 24 is very undesirable because these chips may deposit on the coil insulation and such metal deposits can short out insulation and cause a dielectric failure. Moreover, the presence of metal chips in the insulating liquid impairs the dielectric strength of the insulating liquid itself, and this can lead to a dielectric failure in regions of the insulating liquid where there are high electric stresses.

The box-like enclosure 51 provides significant protection against such dielectric failures. Any chips that are detached from the core and which fall toward the bottom of the tank 12 are intercepted by and captured within the enclosure 51.

The core of the illustrated transformer is connected to ground by suitable means (not shown) and is therefore at ground potential. By confining detached metal chips to the region immediately around the core, the chips are confined for the most part to a region of relatively low electric stress, where their potential for causing dielectric failures is much less.

Figure 2:
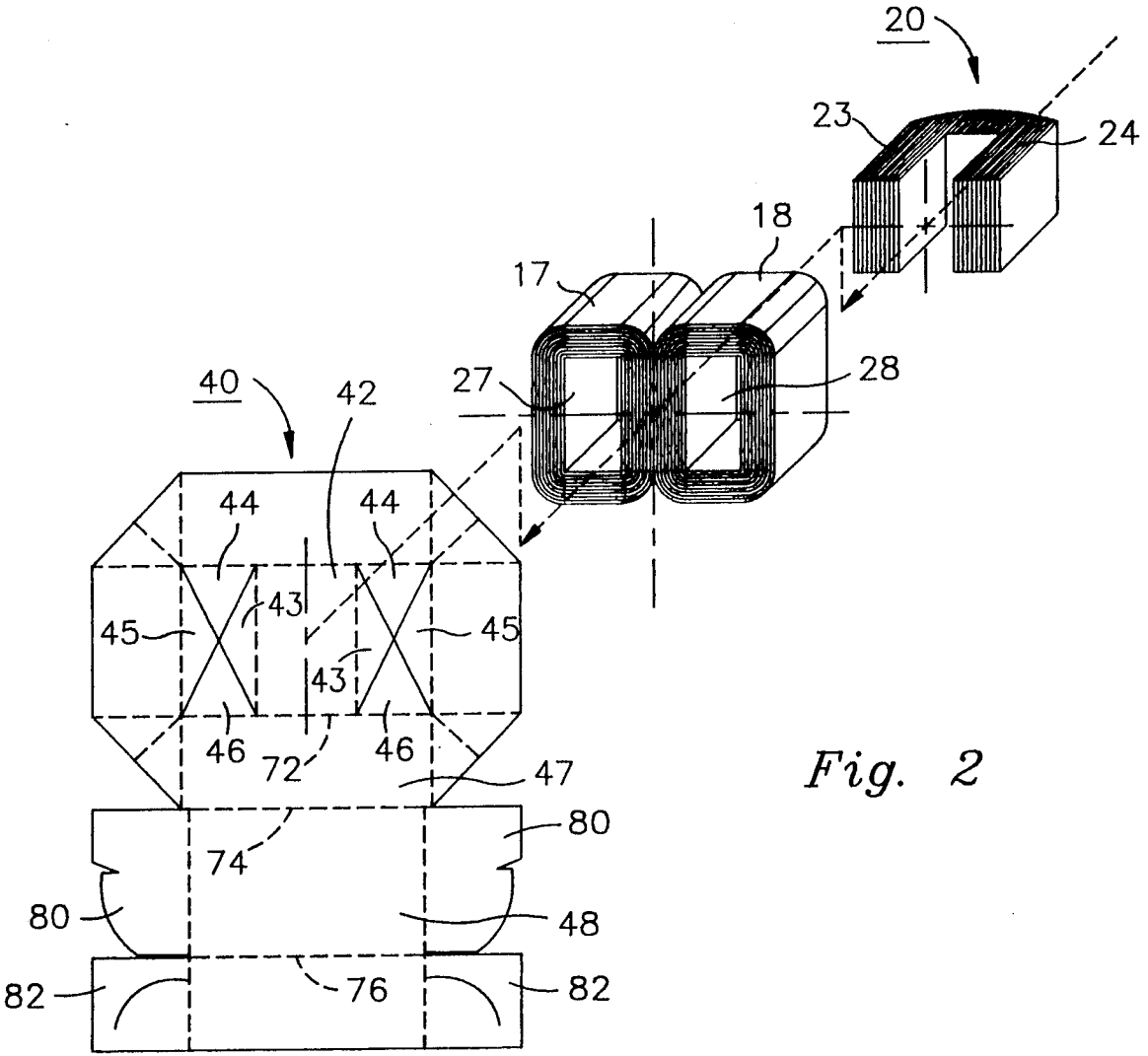
FIG. 2 is a schematic perspective view of the following components of the transformer shown in a separated and exploded state: the core structure 20, the coil structure 17,18, and a chip-containment board 40. Certain details of the core and coil structure have been omitted or simplified for simplicity of illustration.

FIGS. 2–8 illustrate a series of steps employed in assembling the core and coil assembly 15 and in fabricating and incorporating the chip-containment box 51. Referring first to FIG. 2, the amorphous alloy core is shown at 20, the coil structure at 17 and 18, and the chip-containment board (or chipboard) at 40. These components are shown in FIG. 2 in a separated and exploded state where they are positioned just prior to assembly. The chip-containment board 40 is preferably formed from 10 mil thick electrical-grade kraft paper by stamping out from a rectangular sheet, using a suitable die, the form shown. The solid lines in the chip-containment board 40 represent locations where the rectangular sheet has been cut completely through by the die, whereas the dotted lines represent indentations in the form of creases or perforations formed by the die in the kraft paper to provide easily-folded regions.

Figure 3:
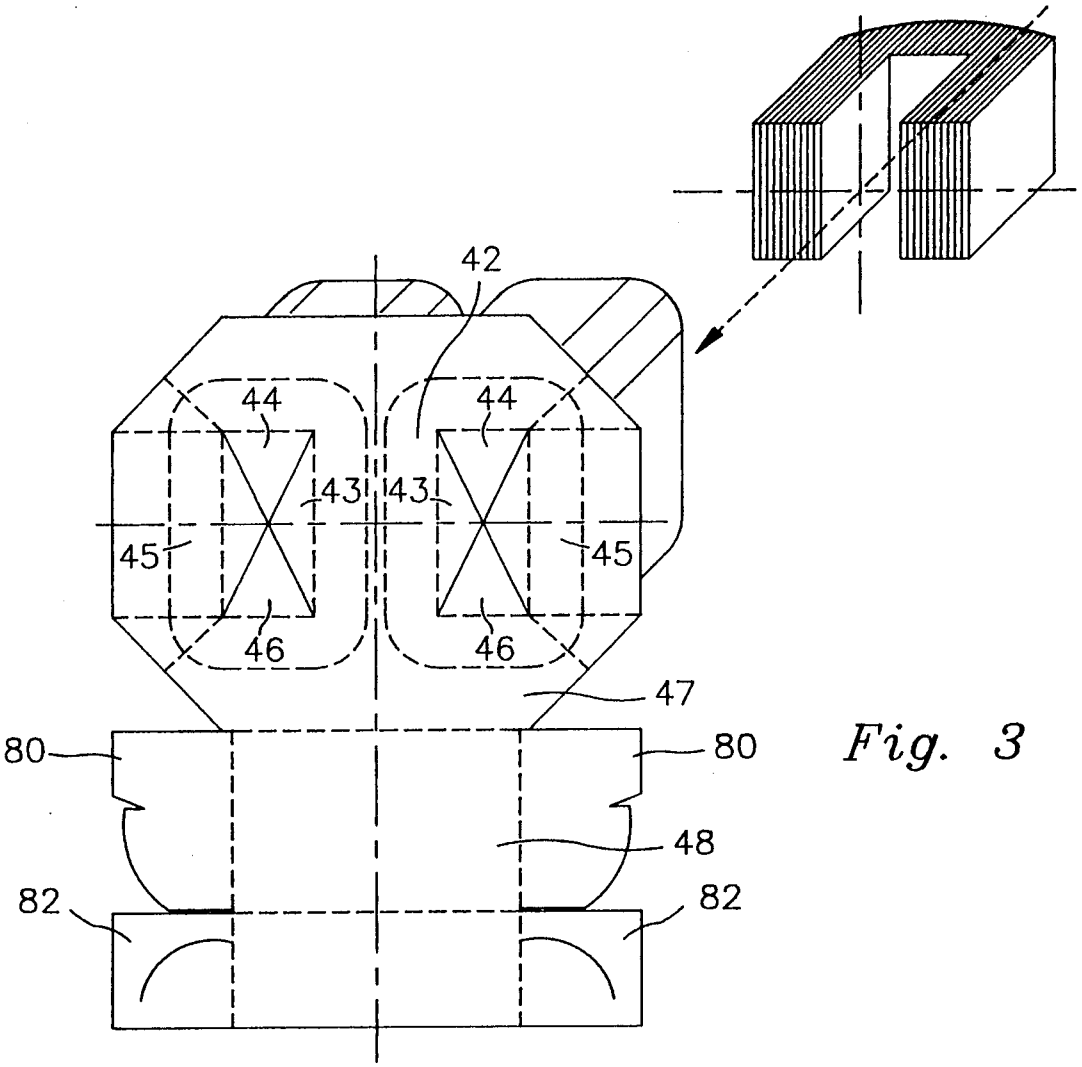
FIG. 3 is a perspective view of the components of FIG. 2, with the chip-containment board 40 shown positioned against one face of the coil structure 17, 18
Figure 4:
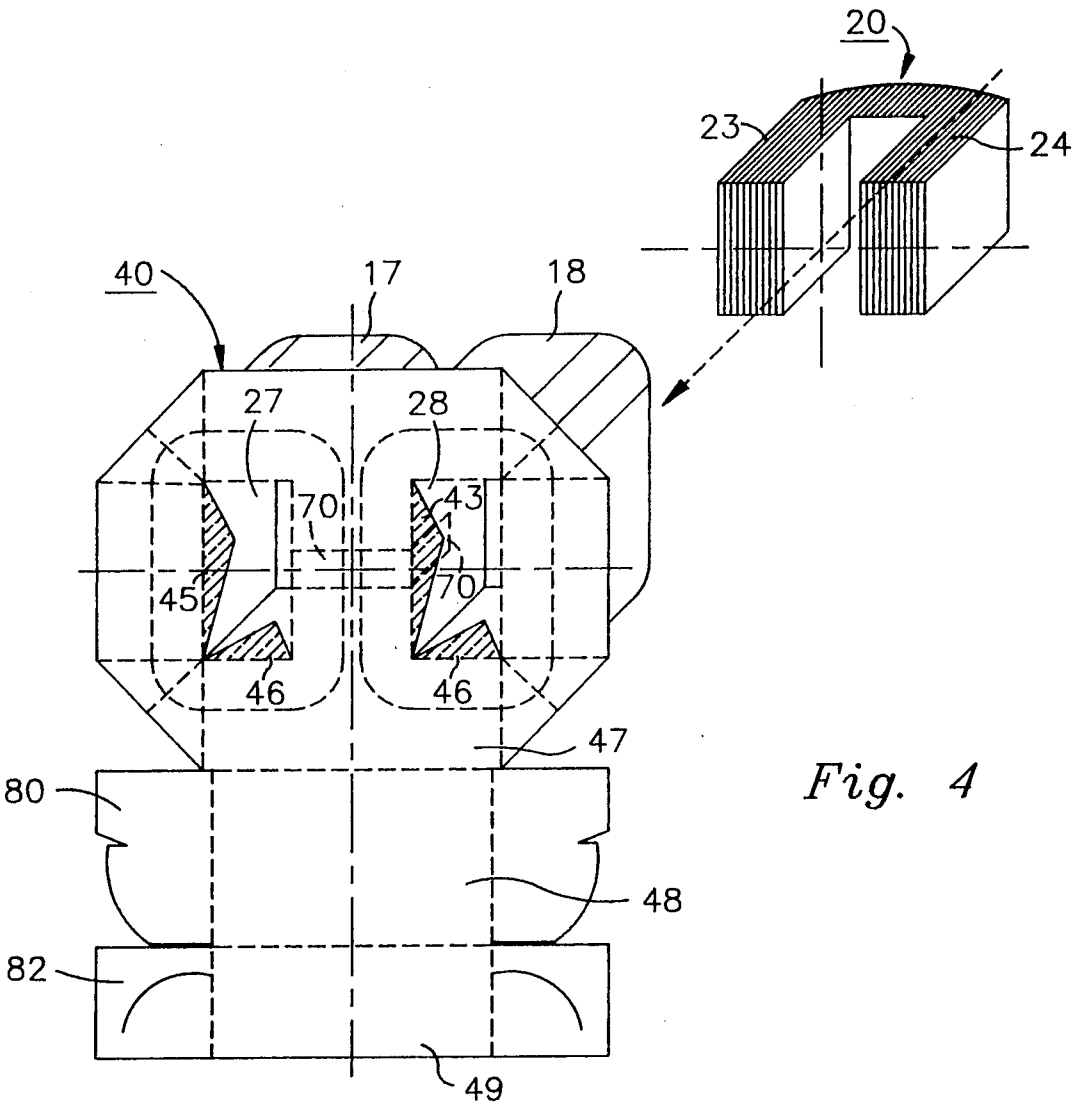
FIG. 4 is a view similar to FIG. 3 except that certain flaps on the chip-containment board have been folded into the coil windows 27, 28 to form liners for the coil windows.

As shown in FIGS. 2 and 3, the chip-containment board 40 comprises a first portion 42 that is adapted to extend between the two coil windows 27 and 28 and contains at each of its spaced-apart ends four triangular flaps 43, 44, 45, and 46. As shown in FIG. 3, the board 40 is first placed against the lower face of the coil structure in such a position that flaps 43–46 line up with the coil windows 27 and 28. Then, as shown in FIG. 4, the flaps 43–46 are folded into the coil windows 27 and 28 to form a liner for each of the coil windows. Thereafter, the flaps are taped to the flat inner walls of the rectangular coil windows to hold the flaps closely against these walls and to prevent relative motion between the coils and the chip-containment board 40. In a preferred embodiment, a length of tape, as shown by dotted lines 70 in FIG. 4, extends from the inner wall of one coil window 28 over the triangular flap 43, then along the portion 42 of the chip-containment board 40, then into the window 27 of the other coil along its flap 43 and its inner wall.

Figure 5:
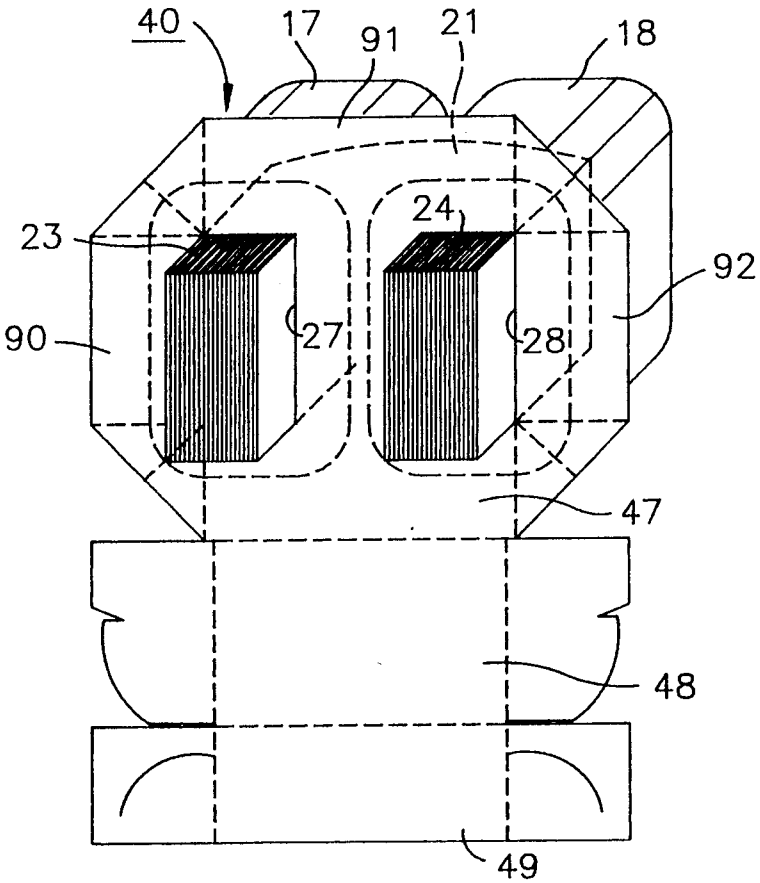
FIG. 5 is a view similar to FIG. 4 except showing the core legs 23 and 24 inserted into the windows 27, 28 of the coil structure 17, 18.
Figure 6:
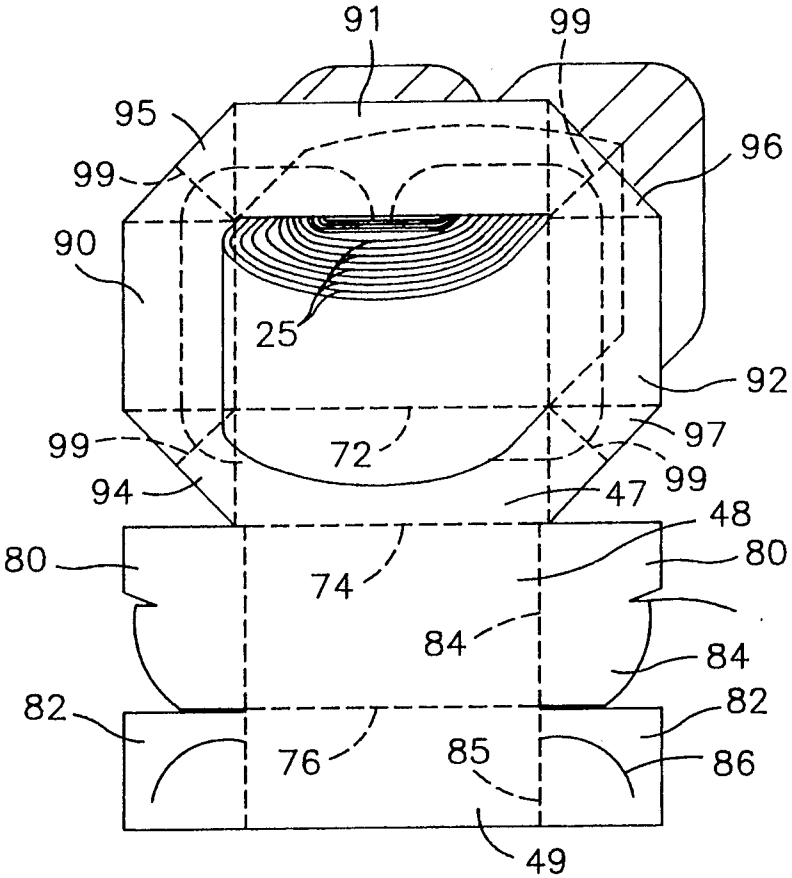
FIG. 6 is a view similar to FIG. 5 except that portions of the lower yoke 22 of the core have been folded together to remake the joints 25. The chip-containment board 40 is still flat and unfolded.
Figure 7:
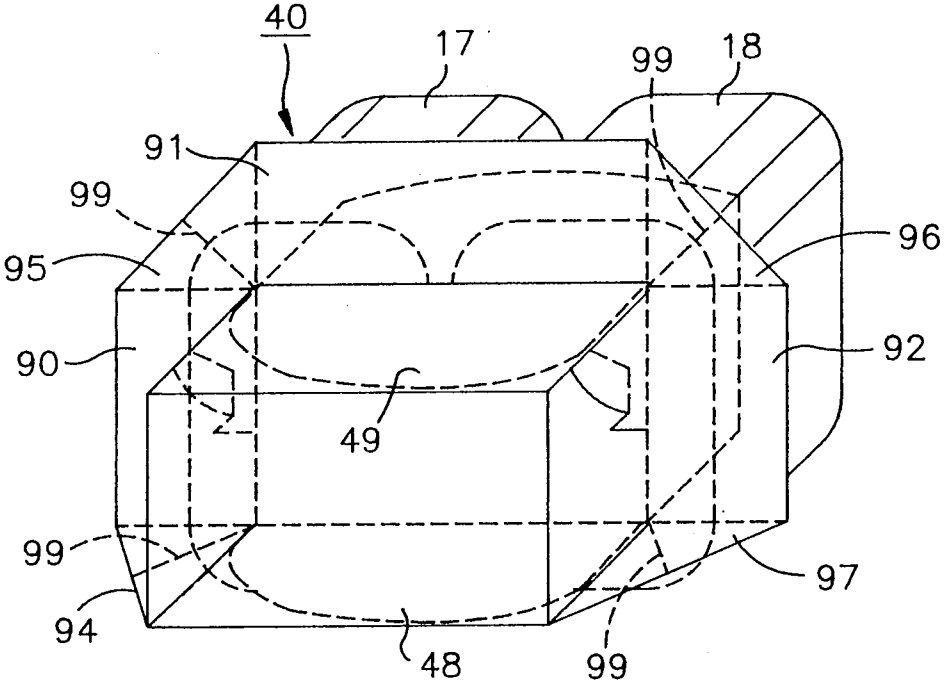
FIG. 7 is a view similar to FIG. 6 except that portions of the chip-containment board 40 have been folded around the lower yoke 22 to form a partially-completed chip-containment box 51.

As a next step, shown in FIG. 5, the legs of the core are inserted into the coil windows until the upper yoke 21 engages the flanges 34, 36 (FIG. 1) at the top of the coil structure 17, 18. Then, as shown in FIG. 6, the two portions of the lower yoke 22 that protrude past the chip-containment board 40 are folded toward each other to remake the joints 25 in the lower yoke. This holds the chip-containment board 40 in its position of FIG. 6.

An important function of the chipboard 40 is that it forms a barrier that covers the entire lower face of the coil structure 17, 18 during the time the lower yoke portions are being folded into alignment with each other to remake the joints 25. This barrier, which comprises chipboard portions 42, 90, 91, 92 and 47, isolates this lower face of the coil structure from the lower yoke portions and thus effectively blocks chips detached from the lower yoke portions and the joints 25 from reaching the lower face of the coil structure.

After the joints 25 have been remade, the edges of the amorphous metal strip within the core 20 that had not previously been covered by the adhesive coating 26 (i.e., in the lower yoke 22 and the corners at opposite ends of the lower yoke) are covered by brushing or spraying onto these edges an adhesive bonding material, preferably of the same composition as the adhesive coating 26. When this additional coating has dried, the sleeve 30 (of FIG. 1) is applied over the joints 25. This additional coating and the sleeve 30 serve to reduce the chances that amorphous alloy chips will be detached and fall from the edges of the amorphous strip in this lower region of the core.

As a next step, the additional portions 47, 48, and 49 of the chip-containment board are folded about the lower yoke 22 of the core 20 to form a box that has as its lid the portion 42 of the chip-containment board 40 that extends between the coil windows 27 and 28. Folding takes place along the crease lines 72, 74, 76, and this facilitates the folding operation and makes it easier to form a box of predictable, predetermined shape and size. The end regions 80 and 82 of these additional portions 48 and 49 are folded over along creases 84 and 85 (FIG. 6) to form end walls for the box. Each pair of these end regions 80 and 82 includes a tab 83 and a slot 86 which cooperate to lock these additional regions together when they are folded into juxtaposed relationship. The tab 83 is inserted into slot 86, and the shoulder 87 on the tab blocks release of the tab from the slot.

Figure 8:
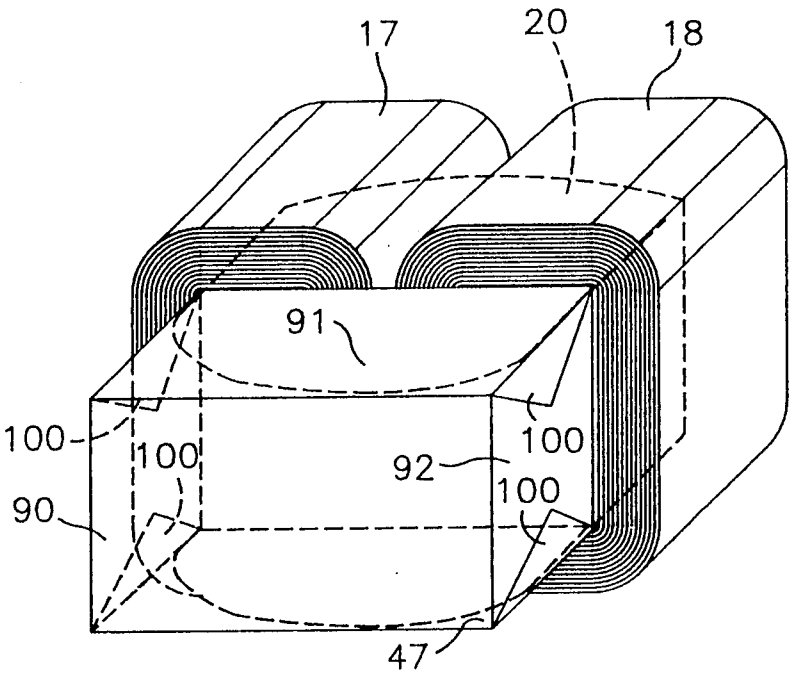
FIG. 8 is a view similar to FIG. 7 except that the portions 90, 91, and 92 of the FIG. 7 chip-containment board have been folded about the box 51 to impart a double thickness to certain of its walls.

After the above-described box comprising portions 47, 48, and 49 has been formed, the still-intact portions 90, 91, and 92 of the chip-containment board 40 are folded about the box as shown in FIG. 8 to provide double thickness for some of the walls of the box. At the triangular corner regions 94, 95, 96, 97 (FIG. 7) where portions 47, 90, 91, and 92, of the chip-containment board are joined, the corner regions are folded along crease lines 99 to form triangular flaps 100 shown in FIG. 8. Preferably, these triangular flaps 100 are held down by adhesive tape (not shown) applied to the finished box. This tape helps to hold the box in its final form.

After the chip-containment box 51 is thus formed about the lower yoke 22 of the core 20, the clamping plates 50 and 52 of FIG. 1 are applied, with the vertically-extending insulating blocks 54 positioned between the clamping plates and the coil structure 17, 18. The clamping band 58 is inserted between clamping plates 50 and 52, as shown in FIG. 1, and tensile forces are applied to the clamping band to force the clamping plates 50 and 52 together, thereby clamping the coil structure 17, 18 between the clamping blocks 54. As shown in FIG. 1, the clamping band 58 extends between the clamping plates 50 and 52 via the coil windows 27 and 28. Slots 62 are provided in the bottom wall of the chip-containment box 51 to permit the clamping band to pass therethrough.

It will be apparent from the above description of FIGS. 2–8 that it is a simple matter to fabricate the chip-containment box 51 and to incorporate it into the core and coil assembly of the transformer. Almost all of the forming operations are folding steps which can be easily carried out by hand along pre-formed indentations, e.g., crease lines or perforations. The only cutting operation required from the assembler is the simple one used for introducing the slots 62 for the clamping band. While these slots 62 could be introduced by the die used for stamping out the chipboard 40, we prefer to introduce them after the box 51 has been formed so as to facilitate properly locating them. The only taping operations used are those for taping the flaps 43–46 into the core window and for taping down the flaps 100 at the end of the box-forming process.

While the illustrated form of our invention includes creases or perforations to facilitate folding at the base of each of the flaps 43–46, it is to be understood that our invention in its broader aspects comprehends a construction in which some or all of these creases or perforations are omitted.

While we have shown and described a particular embodiment of the invention, it will be obvious to those skilled in the art that various changes and modifications may be made without departing from the invention in its broader aspects; and we, therefore, intend in the appended claims to cover all such changes and modification.

What we claims as new and desire to secure by Letters Patent of the United States is:

1. In a transformer that comprises a tank containing insulating liquid, (a) a pair of hollow coils disposed in side-by-side relationship within said liquid, each coil including two end faces and a window extending between said end faces, (b) an amorphous alloy core linked to said coils and comprising first and second yokes and two spaced-apart legs interconnecting said yokes and disposed respectively within the windows of said coils, said second yoke including joints and yoke portions on opposite sides of said joints that are respectively integral with said two legs, said yoke portions being generally aligned with said two legs while said two legs are being inserted into said coil windows during linking of said core to said coils, (c) a chip-containment board of electrical insulating material containing two openings respectively aligned with said coil windows, said chip-containment board being located adjacent one of said coil end faces and having a portion extending between said coil windows and located between said one coil end face and said second yoke, and (d) said chip-containment board further comprising additional portions that are foldable into a box that surrounds said second yoke and includes as a lid said portion of the board that extends between said coil windows.

2. The apparatus of claim 1 in which said chip-containment board before being folded to form said box contains indentations along which said additional portions of the board can be easily folded to form said box.

3. The apparatus of claim 1 in which said chip-containment board further includes flaps that are folded into positions within said coil windows and form liners for the respective coil windows, the liners leaving clearance space within the coil windows around the core legs through which chips detached from said core can fall past the liners into said box.

4. The apparatus of claim 3 in which at least some of said flaps are joined to the peripheries of said openings through regions of said chip-containment board that are indented before folding of the latter flaps to allow said latter flaps more easily to be folded into positions within said coil windows.

5. The apparatus of claim 1 in which said chip-containment board includes supplemental portions partially covering said one end face of the coils when said core joints are being closed after insertion of said core legs through said coil windows, said supplemental portions being foldable over said box to impart double thickness to some of the walls of the box.

6. The apparatus of claim 1 in which said additional portions of (d), claim 1, include portions that are foldable into end walls for said box that are located at opposite ends of said second yoke.

7. The apparatus of claim 6 in which said portions foldable into each end wall of said box include one portion that contains a tab and another portion that contains a slot into which said tab fits and locks said latter two portions together when said latter two portions are folded to form said end wall.

* * * * *